US005730160A

United States Patent [19]

Schneider

[11] Patent Number: 5,730,160

[45] Date of Patent: Mar. 24, 1998

[54] SEGMENTED FILTER CIGARETTE

[75] Inventor: Werner Schneider, Quickborn, Germany

[73] Assignee: British-American Tobacco (Germany) GmbH, Hamburg, Germany

[21] Appl. No.: 565,151

[22] Filed: Nov. 30, 1995

[30] Foreign Application Priority Data

Dec. 12, 1994 [DE] Germany ..... 44 44 157.6

[51] Int. Cl.[6] ..... A24D 1/00

[52] U.S. Cl. ..... 131/364; 131/360; 131/361; 131/336; 131/365

[58] Field of Search ..... 131/364, 361, 131/360, 365, 339, 340

[56] References Cited

U.S. PATENT DOCUMENTS

| | | | |
|---|---|---|---|
| 4,730,628 | 3/1988 | Townsend et al. | 131/360 |
| 4,874,004 | 10/1989 | Borowiski et al. | 131/364 |
| 5,439,011 | 8/1995 | Schneider | 131/360 |

FOREIGN PATENT DOCUMENTS 0 174 550 1/1991 European Pat. Off. .

*Primary Examiner*—Vincent Millin
*Assistant Examiner*—Charles W. Anderson
*Attorney, Agent, or Firm*—Armstrong, Westerman, Hattori, McLeland & Naughton

[57] ABSTRACT

The invention relates to a segmented filter cigarette comprising a tobacco rod including at least two segments of differing tobacco fillings, a wrapping for said tobacco rod, and a filter, said at least two segments of said tobacco rod having a coaxial structure, each comprising an inner core of tobacco material, a wrapping for said inner core, a jacket of a different tobacco material and a wrapping for said jacket; the tobaccos of said inner cores of said segments have the same or a very similar condensate potential; the tobaccos of said jackets of said segments have the same or a very similar condensate potential which differs, however, from the condensate potential of said inner cores; by defining the resistances to draw of said inner cores and of said jackets of said segments and by adapting said filter it is achieved that the smoke is drawn substantially from the region having a high condensate potential of the first-burning segment during smoking of the segmented filter cigarette, and the smoke is drawn substantially from the region of said segment having the lower condensate potential during smoking of the filter-end segment to achieve the same perception of taste puff-for-puff. By specially designing the coaxial filter an increasing proportion of smoke is introduced into the filter part having high filtering effectiveness during smoking of said first segment.

47 Claims, 1 Drawing Sheet

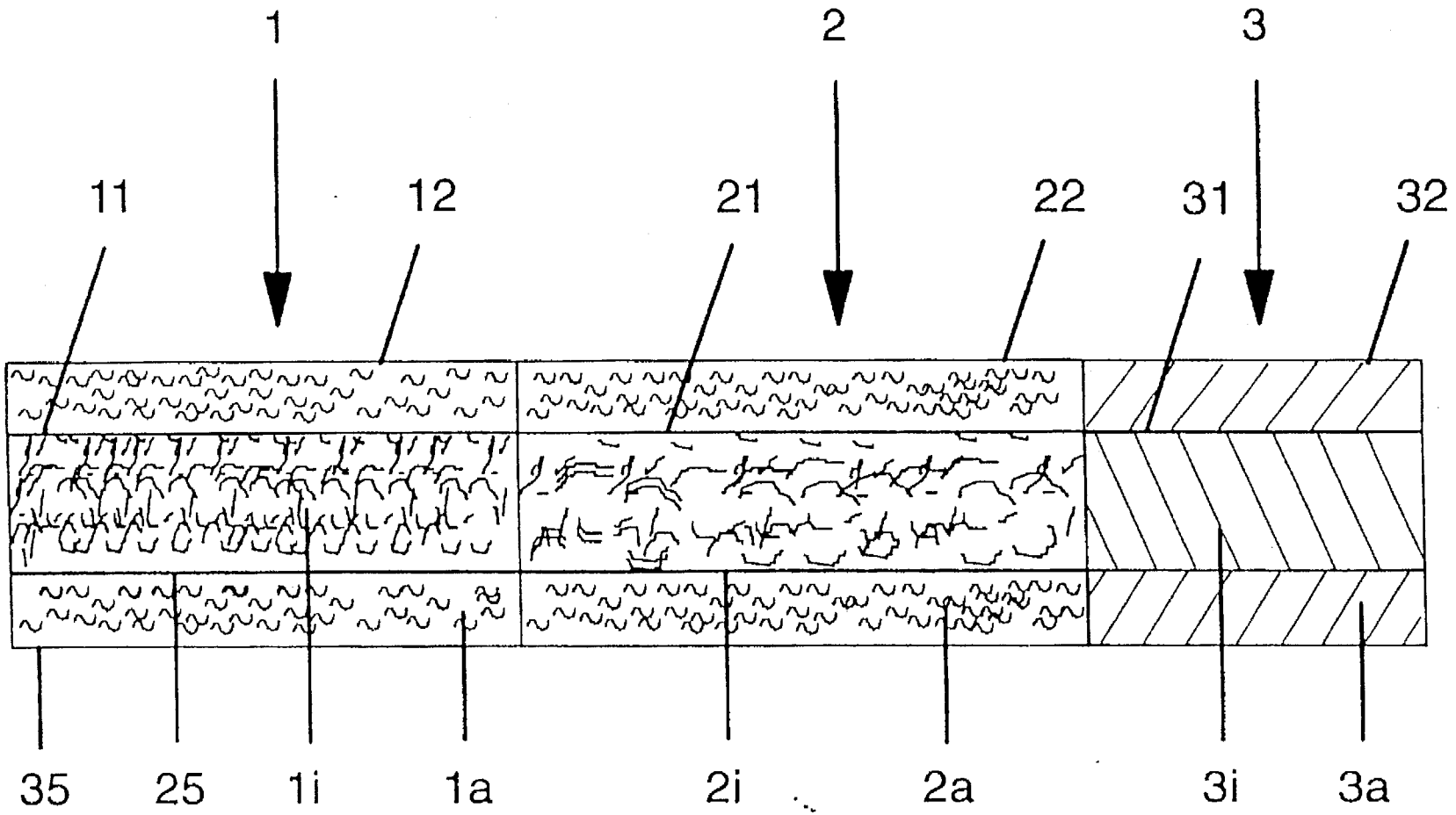
32
3
31
22
2
21
12
1
11
3a
3i
2a
2i
1a
1i
25
35

SEGMENTED FILTER CIGARETTE

BACKGROUND OF THE INVENTION

1. Field of the Invention

The invention relates to a segmented filter cigarette. Such cigarettes comprise a tobacco rod including at least two segments of differing tobacco fillings, a wrapping for said tobacco rod, and a filter.

2. Description of the Prior Art

One problem experienced in general with conventional cigarettes relates to the fact that with standard smoking they show an increase in the puff-by-puff condensate delivery with increasing smoked length. Since, in keeping with the specification on the pack, light and ultralight cigarettes are allowed to have only a low condensate delivery per total cigarette, this change in condensate delivery results in these cigarettes having an unsatisfactory full taste during initial smoking and first puffs and attaining the expected taste only after a few puffs.

To solve this problem, a segmented cigarette has been proposed, as is known from EP 0 174 550 B1. The smoking article described therein features a tobacco rod having two axial segments, the unlit segment having an average density at least 20% greater than the average density of the fire-end segment. In addition, the fire-end segment has a nicotine delivery which is higher than that of the unlit end segment to furnish a strong taste already for the first puffs.

The drawback in smoking such a cigarette is that an abrupt change in taste results due to these differences at the transition between the segments, the reason for this being that greatly differing tobaccos need to be used here, as is expressly mentioned in the aforementioned European patent.

SUMMARY OF THE INVENTION

It is thus the object of the present invention to provide a segmented filter cigarette which overcomes the disadvantages of prior art as described above. More particularly, the intention is to propose a segmented filter cigarette exhibiting no abrupt difference in taste at the segment transition and enabling the same or similar tobaccos to be used in the segments. In this arrangement boosting the strength of the first puffs may be intensified not only by the structure of the tobacco rod, but additionally by the combination with a special filter.

This object is achieved by a segmented-filter cigarette in which at least two segments of said tobacco rod have a coaxial structure, each comprising an inner core of tobacco material, a wrapping for said inner core which preferably has a low permeability to air, a jacket of a tobacco material, and a wrapping highly permeable to air for said jacket; the tobaccos of said inner cores of said segments have the same or a very similar condensate potential; the tobaccos of said jackets of said segments have the same or a very similar condensate potential which differs very greatly from the condensate potential of said inner cores; by defining the resistances to draw of said inner cores and of said jackets of said segments and by adapting said filter it is achieved that the smoke is drawn substantially from the region having a high condensate potential of the first-burning segment during smoking of the segmented filter cigarette, and the smoke is drawn substantially from the region of said segment having the lower condensate potential during smoking of the filter-end segment.

Such a coaxial structure permits a varied configuration of the inner and outer sections of the segments as regards the desired taste effect which may be favorably influenced by defining the resistances to draw in the inner and outer sections so that no abrupt difference in taste, due to the various tobaccos involved, results at the segment transition, although the inner cores of the segments and the jackets of the segments have the same or similar condensate potential. This means that the same or very similar tobaccos may be employed for the segments in sequence. It is also achieved that even during the initial puffs in being smoked, the cigarettes specified according to the invention exhibit very good taste characteristics which are substantially maintained throughout the complete course of smoking. Accordingly, the total delivery of condensate resulting during smoking is distributed more evenly among the various puffs.

In smoking of the first-burning segment, a successive adaptation to the flow conditions in the subsequent segment results, this segment being suitably specified to contribute towards boosting the strength of the first puffs. Namely, as long as the first-burning segment is being smoked, the smoke is drawn preferably from its region having a high condensate potential, resulting in the resistance to draw ratio automatically changing until the next following segment is attained. In this segment the resistance to draw ratio remains relatively constant, the smoke being drawn from the region having the lower condensate potential to a substantially greater proportion than in the first-burning segment.

The length of the total tobacco rod of a cigarette in accordance with the invention may be 40 to 100 mm, it preferably being 45 to 70 mm. The inner cores of the tobacco rod may have a diameter of 3 to 6 mm and preferably 4.5 to 5.5 mm. As far as the length of this first-burning segment is concerned, this corresponds to 0.5 to 0.8 times and preferably 0.3 to 0.4 times the total length of the tobacco rod in the preferred embodiments.

Preferably, both the inner cores and the jackets of the various segments have an additional common wrapping produced of paper or tobacco sheet. This measure can guarantee economic production in forming the longitudinal axial rod. In certain cases this common wrapping may serve as the sole wrapping.

The segmented filter cigarette according to the invention is preferably characterized by it comprising a coaxial filter consisting of filter core, a wrapping for the filter core, a filter jacket and a wrapping for the filter jacket, filter core and filter jacket being structured of known filter materials, especially fibers or non-woven fabric. The diameter of the filter core may be 2.5 to 6.5 mm and preferably 3.5 to 5.5 mm.

Preferably, the wrapping of the filter core consists of paper or tobacco sheet, sheet material of cellulose acetate or polyolefines, such as particularly polyethylene or polypropylene also being possible, and exhibits a low permeability to air or is preferably impermeable to air. In this arrangement the filter may include further filter segments adjoining the mouth end. In one preferred embodiment of the segmented filter cigarette according to the invention the coaxial filter elements are configured so that one of the two coaxial filter parts, namely filter core or jacket, exhibit a high filtering effectiveness whilst the other in each case has a low filtering effectiveness.

The above configuration depends on the structuring of the tobacco rod in each case, for which substantially two possibilities exist.

The first embodiment of the segmented filter cigarette in accordance with the invention is characterized in that the ratio of the resistance to draw of the jacket of the first-burning segment to the resistance to draw of the inner core of the first-burning segment is smaller that the ratio of the resistance to draw of the jacket of the filter-end segment to the puff resistance of the inner core of the filter-end segment, the tobaccos of both jackets having a high condensate potential.

By this configuration it is assured that in lighting the cigarette and during the first puffs the smoke is preferably drawn from the jacket of the first-burning segment, providing a high perception of taste during these first puffs. During smoking of the unlit or filter-end segment the smoke is preferably drawn from the inner core thereof, i.e. the region having a low condensate potential so that the perception of taste remains substantially the same in strength for both segments.

The first modified form as described above of the segmented filter cigarette according to the invention is identified in the following as version A. In one preferred embodiment of the cigarette according to version A the resistance to draw of the jacket of the first-burning segment, relative to a tobacco rod length of 63 mm is 20 to 40 mm WC, preferably 25 to 35 mm WC, whilst the resistance to draw of the inner core is 300 to 600 mm WC and preferably about 450 to 550 mm WC. This version A may be further characterized in that the resistance to draw of the jacket of the filter-end segment, relative to a tobacco rod length of 63 mm, is 100 to 300 mm WC, preferably 130 to 170 mm WC, whilst the resistance to draw of the inner core is 50 to 150 mm WC and preferably about 75 to 125 mm WC.

A coaxial filter assigned to this version A has advantageously a filtering effectiveness which is 10 to 60%, preferably 10 to 30% for the filter core, whilst that of the filter jacket is 70 to 100% preferably 90 to 100% and the filter has a degree of ventilation from 0 to 80%.

In a segmented filter cigarette according to the present invention it is possible to adjust the resistances to draw of the filter elements as a function of the filter ventilation employed so that the ratio of the amount of smoke flowing into the periphery of the coaxial filter to the amount of smoke flowing into the core region of the coaxial filter substantially equals the ratio of the amount of smoke flowing out of the tobacco jacket to the amount of smoke flowing out of the tobacco core, in each case after the first-burning segment of the tobacco rod having been smoked.

Accordingly, with a suitable specification, specially adapted to the tobacco rod the coaxial filter is able to make a further significant contribution to enhancing the strength of the first puffs. This is achieved in that, depending on the difference between the flow conditions in the rod, which in turn depend on the changing puff resistance conditions there, and the flow conditions in the filter, a changing percentage of smoke is led into the highly effective filter jacket.

In the following a second possibility of configuring the segmented filter cigarette according to the invention as regards the tobacco rod and the filter is described. This version is identified as version B.

The segmented filter cigarette in accordance with version B of the present invention is characterized in that the ratio of the resistance to draw of the jacket of the first-burning segment to the resistance to draw of the inner core of the first-burning segment is greater than the ratio of the resistance to draw of the jacket of the filter-end segment to the resistance to draw of the inner core of the filter-end segment, the condensate potential of the tobaccos of the inner cores being high whilst that of the jacket is low.

In version B the smoke is first preferably drawn from the inner core of the first-burning segment by the adjustment of the resistances to draw, resulting in a strong perception of taste in initial smoking and during the first puffs. Smoking the first-burning segment results in successive adaptation to the flow conditions in the filter-end segment in which—again due to adjustment of the resistances to draw—the smoke is preferably drawn from the jacket with the low condensate potential. This again results in a cigarette, the taste perception of which during the first puffs is sufficiently strong and which exhibits no abrupt change in taste at the segment transition, i.e. here too the condensate delivery is distributed evenly to each puff.

In a preferred embodiment of the segmented filter cigarette according to version B the resistance to draw of the jacket of the first-burning segment, relative to a tobacco rod length of 63 mm, is 100 to 300 mm WC and preferably roughly 125 to 175 mm WC, whilst the resistance to draw of the inner core is 50 to 100 mm WC and preferably roughly 60 to 80 mm WC.

In this arrangement the version B of the segmented filter cigarette according to the invention is characterized in that the resistance to draw of the jacket of the filter-end segment, relative to a tobacco rod length of 63 mm, is 25 to 100 mm WC and preferably 30 mm WC, whilst the resistance to draw of the inner core of this segment is 125 to 300 mm WC and preferably about 150 mm WC.

The coaxial filter assigned to the version B is configured so that the filter effectiveness of the filter core is 70 to 100%, preferably 90 to 100%, whilst the filter effectiveness of the filter jacket is 10 to 60%, preferably 10 to 30% and the filter has a degree of ventilation of 0 to 80%.

Both of the versions of the segmented filter cigarette according to the invention as described above have the advantage, even when formulated as light and ultralight cigarettes, that even in initial smoking and during the first puffs a relatively strong perception of taste results which changes only slightly in the course of further smoking.

BRIEF DESCRIPTION OF THE DRAWING

The invention will now be explained in more detail with reference to the sole Figure of the attached drawing, showing a section through a segmented cigarette according to the invention.

DESCRIPTION OF THE PREFERRED EMBODIMENT

The embodiment of the segmented filter cigarette according to the invention shown here has a fire-end and first-burning coaxial segment 1 and a mouth- and/or filter-end coaxial segment 2, forming together the tobacco rod. At the filter-end segment 2 a coaxial filter 3 is applied to the tobacco rod, generally by a prior art tipping paper (not shown in the FIG.).

The first-burning segment 1 comprises the following components: an inner core 1*a* of a tobacco material, a wrapping 11 for the inner core 1*a*, a jacket 1*a* surrounding the inner core and a wrapping 12 for the jacket 1*a*. The second segment 2 adjoining the first segment 1 has the following components: an inner core 2*i* of tobacco material, a wrapping 21 for the inner core 2*i*, a jacket 2*a* surrounding the inner core 2*i* and the wrapping 21 thereof, and a wrapping 22 for the jacket.

In this arrangement the wrappings 11 and 21 for the inner cores 1*a* and 2*i* are produced of paper or tobacco sheet and exhibit a low permeability to air. They may also be totally impermeable to air.

The outer wrappings 12, 22 of the jackets 1*a* and 2*a* are also formed of cigarette paper or tobacco sheet and are preferably highly permeable to air.

To simplify the longitudinal axial formation of the rod and thus make for more cost-effective production both the inner cores 1*a*, 2*i* and the tobacco jackets 1*a*, 2*a* of the two segments 1, 2 may have additionally a common outer wrapping; in the FIG. this common outer wrapping for the two inner cores 1*a*, 2*i* is designated by the reference numeral 25 and the common outer wrapping for the two jackets 1*a*, 2*a* by the reference numeral 35.

The tobaccos of the two inner cores 1*a*, 2*i* have the same or a very similar condensate potential; also the tobaccos of the two jackets 1*a*, 2*a* have the same or a very similar condensate potential, the condensate potentials of the inner cores 1*a*, 21 and the jackets 1*a*, 2*a* being greatly different, however, i.e. the one condensate potential is very low and the other is relatively high.

Segment 2 is followed by a coaxial filter 3 having a filter core 3*a*, a wrapping 31 for the filter core 3*a*, a filter jacket 3*a* and a wrapping 32 for the filter jacket 3*a*. The connection between tobacco rod and filter 3 is achieved by the usual means, e.g. a tipping paper.

The wrapping 31 consists of paper or a sheet, e.g. of cellulose acetate or polyolefines such as e.g. polyethylene or polypropylene, and has a low permeability to air, it being preferably impermeable to air.

Both the filter core 3*a* and the filter jacket 3*a* consist of the usual filter materials in the form of fibers or non-wovens, one of the two filter parts, i.e. filter core 3*a* or filter jacket 3*a* being highly effective, whilst the other in each case is relatively less effective.

The diameter of the filter core 3*a* corresponds to that of the tobacco rod core.

The wrapping 32 for the filter jacket 3*a* may be either inherently permeable to air or it may be produced of a material impermeable to air, however, which in the usual way, for instance by laser beams, is provided with perforations and thus specifically rendered air-permeable, to furnish the desired filter ventilation.

The basic principle of the segmented cigarette lies in the fact that by suitably adapting the condensate potentials of the two segments 1, 2 the strength of the first puffs is enhanced. As long as the first segment 1 is being smoked, the smoke is drawn thereby substantially from the region having a high condensate potential,- resulting in the correspondingly adapted resistance to draw ratio between the resistances to draw of the inner core and the jacket changing until the corresponding value of the segment 2 is achieved. From then on, the resistance to draw ratio of the segmented cigarette remains almost constant. In segment 2 the smoke is drawn to a substantial extent from the region of low condensate potential.

When suitably specified and in being specially adapted to the two segments 1, 2 of the tobacco rod the coaxial filter 3 is able to provide a further significant contribution towards enhancing the strength of the first puffs. This is achieved in that, depending on the difference between the flow conditions in the rod, which in turn depend on the changing resistance to draw conditions there, and on the flow conditions in the filter a continuously increasing percentage of the smoke is introduced into the highly effective filter region in each case, until segment 1 has been smoked.

The following explains the two principal versions A and B of the segmented cigarette according to the invention; in both versions the rod length Ls, i.e. the length of the overall tobacco rod comprising the two segments 1 and 2, amounts to about 60 mm; the diameter of the inner core 1*a*, 2*i* of the two segments is approx. 5 mm.

The overall diameter of the tobacco rod and filter 3 has the usual value of roughly 7.9 mm.

The two versions A and B differ substantially by the spatial arrangement of the tobacco having a high condensate potential: in the version A the tobaccos of the two jackets 1*a*, 2*a* have a very high condensate potential, both the same or differing tobacco materials being able to be used, whilst in keeping with the general rule as explained above, the tobacco materials of the two inner cores 1*a*, 2*i* have a very low condensate potential. If the same tobacco materials are used the differing condensate potentials may be achieved by differing the tobacco density in each case. Preferably, however, differing tobaccos are employed.

In version B the tobacco materials of the two inner cores 1*a*, 2*i*, which may be either the same or different, have a very high condensate potential, whilst the tobacco materials of the two jackets 1*a*, 2*a*, which may also be the same or different, have a low condensate potential. Here too, the above comments apply as regards using the same or differing tobaccos.

At the same time the two tobacco rod segments 1, 2 have a significantly differing ratio q of their corresponding resistances to draw Za /Zi, Za being the resistance to draw of the tobacco jacket 1*a*, 2*a* and Zi being the resistance to draw of the inner core 1*i*, 2*i*.

The resistance to draw ratio q for the two regions 1*a*, 1*a* of the first segment 1 is designated qi and that of the two regions 2 is designated q2.

The two versions A and B of a segmented filter cigarette according to the invention will now be described in detail with reference to the sole Figure.

Version A

In Version A the tobaccos of the two inner cores 1*a* and 2*i* have the same or very similar condensate potential which is, however, very much lower than the condensate potential of the two jackets 1*a* and 2*a*. For adjusting the smoking and taste conditions the following relates to the ratio of the resistance to draw Za of a jacket to the resistance to draw Zi of an inner core. For the version A having a tobacco with a high condensate potential in the tobacco jacket, the ratio of the resistances to draw ql needs to be smaller in segment 1 than the ratio q2 of the resistances to draw Za /Zi in segment 2.

Selecting the length L1 of the first segment 1 determines the number of "strengthened" puffs, i.e. the effectiveness achieved. In this example the length L1, relative to the overall length Ls of the tobacco rod including the two segments 1, 2, is 0.35 Ls.

The resistance to draw Za of the jacket 1*a* of the first segment 1, relative to an overall length of the tobacco rod of 63 mm, is roughly 30 mm WC.

The resistance to draw Zi of the inner core 1*a* of the first segment 1, relative to an overall length of the tobacco rod of 63 mm, is roughly 500 mm WC.

The length of the second segment 2 resulting from the aforementioned adaptation of the length L1 of the first segment is thus in this example 0.65 Ls.

The resistance to draw Za of the jacket 2*a* of the second segment 2, relative to an overall length of the tobacco rod of 63 mm including the two segments 1 and 2, is roughly 150 mm WC.

The resistance to draw Zi of the inner core 2*i* of the second segment 2, relative to an overall length of the tobacco rod of 63 mm, is roughly 100 mm WC.

The filter efficiency of the inner core 3*a* of the filter 3 has a value of roughly 20%, whilst the filter efficiency of the jacket 3*a* of the filter amounts to roughly 95%.

The filter ventilation, produced either by the inherent porosity of the filter wrapping 32 or by perforations, is of the order of roughly 40% to 70%.

In addition, the resistances to draw are to be specified as a function of the filter ventilation of the filter 3 employed so that the ratio sf of the stream of smoke flowing into the jacket 3*a* of the coaxial filter 3 to the stream of smoke flowing into the filter core 3*a* of the coaxial filter 3 is roughly equal to the ratio s2 of the stream of smoke flowing out of the jacket 2*a* of the second segment 2 after the first segment 1 has been smoked to the stream of smoke flowing out of the inner core 2*i* of the second segment 2 after the first segment 1 has been smoked.

By these means in initial and subsequent smoking of segment 1 smoke is initially drawn preferably from the jacket 1*a* of this segment 1, resulting in a relative strong taste perception already in initial smoking and in the first puffs of this cigarette. The resistance to draw ratio q automatically changes during smoking of segment 1 until roughly the resistance to draw ratio q2 of the segment 2 is attained. This remains constant during further smoking since it is achieved from the explained adaptation of the resistances to draw and filter 3 that in smoking segment 2 preferably smoke is drawn from the inner core 2*i*. Also contributing towards adjustment of the taste effect is the coaxial filter 3, the filter jacket 3*a* of which in version A has a high filter effectiveness, whilst the filter effectiveness of the filter core 3*a* is relatively low. In this arrangement an increasing proportion of smoke is introduced in the highly-effective filter jacket 3*a*, depending on the difference between the flow conditions in the rod and the flow conditions in the filter 3, until segment 1 has been smoked.

Version B

As regards the resistance to draw ratio q2 of version B of the segmented filter cigarette according to the invention, the resistance to draw ratio q1 of segment 1 must be greater than the resistance to draw ratio q2 of segment 2.

Relative to the overall length of the tobacco rod, the length L1 of the first segment 1 has roughly the same value as that in version A.

Relative to the overall length of the tobacco rod of 63 mm, the resistance to draw Za of the jacket 1*a* of segment 1 is approx. 150 mm WC.

Relative to the overall length of the tobacco rod of 63 mm, the resistance to draw Zi of the inner ore 1*a* of the first segment 1 is approx. 70 mm WC. Relative to the overall length of the tobacco rod of 63 mm, the resistance to draw Za of the jacket 2*a*, of the second segment 2 is approx. 30 mm WC.

Relative to the overall length of the tobacco rod of 63 mm, the resistance to draw Zi of the inner core 2*i* of the second segment 2 is approx. 150 mm WC.

The inner core 3*a* of the coaxial filter 3 has a filter effectiveness of approx. 95%, whilst the filter effectiveness of the jacket 3*a* of the coaxial filter 3 is approx. 20%.

The filter ventilation is in the region of roughly 40% to 70%.

By these means it is achieved that in smoking the segment 1 the smoke is initially drawn preferably from the inner core 1*a* with the high condensate potential of segment 1, resulting in a relatively strong perception of taste during the first puffs. In the course of segment 1 being smoked the resistance to draw ratio q in turn continues to change, until segment 2 is attained, the resistance to draw ratio q2 of which remains constant. In the case of version B this adjustment of the resistance to draw ratio in segment 2 now results in smoke being drawn preferably from the jacket 2*a* of this segment 2, producing a perception of taste which remains substantially the same in strength over the overall length of the cigarette.

Here too, the filter for enhancing the strength of the first puffs contributes towards an increasing percentage of the smoke being introduced into the highly effective filter segment, i.e. depending on the difference between the flow conditions in the rod and the flow conditions in the filter, until segment 1 has been smoked.

I claim:

1. A segmented filter cigarette comprising a) a tobacco rod including at least two segments of differing tobacco fillings, said segments including a first burning segment and a filter-end segment, b) an outer wrapping around said tobacco rod, and c) a filter attached to one end of said tobacco rod in which d) said at least two segments of said tobacco rod have a coaxial structure, each comprising d1) an inner core of tobacco material, a2) a first wrapping for said inner core d3) a jacket of a tobacco material, and d4) a second wrapping highly permeable to air for said jacket;

e) the tobaccos of said inner cores of said segments have the same or a very similar condensate potential;

f) the tobaccos of said jackets of said segments have the same or a very similar condensate potential which differs from the condensate potential of said inner cores;

said inner cores and said jackets of said segments each having a resistance to draw, the resistance to draw for the inner core and the resistance to draw for the jacket of each segment being different such that, upon smoking of said cigarette:

g1) smoke is drawn substantially from the region having a high condensate potential of first-burning segment during smoking of the segmented filter cigarette, and g2) smoke is drawn substantially from the region of said segment having the lower condensate potential during smoking of the filter-end segment wherein the ratio q1 of the resistance to draw of said jacket of said first-burning segment to the resistance to draw of said inner core of said first-burning segment is smaller than the ratio q2 of the resistance to draw of said jacket of said filter-end segment to the resistance to draw of said inner core of said filter-end segment, and in that the tobaccos of said jackets of the segments have a high condensate potential.

2. The segmented filter cigarette as set forth in claim 1, wherein said tobacco rod has an overall length of 40 to 100 mm.

3. The segmented filter cigarette according to claim 2, wherein the overall length of said tobacco rod is 45 to 70 mm.

4. The segmented filter cigarette as set forth in claim 1, wherein said inner cores have a diameter of 3 to 10 mm.

5. The segmented filter cigarette according to claim 4, wherein said inner cores have a diameter of 3 to 10 mm.

6. The segmented filter cigarette as set forth in claim 1, wherein said first burning segment has a length corresponding to 0.1 to 0.8 the overall length of said tobacco rod.

7. The segmented filter cigarette according to claim 6, wherein said first burning segment has a length corresponding to 0.3 to 0.4 times the overall length of said tobacco rod.

8. The segmented filter cigarette as set forth in claim 1, wherein said inner cores and/or said jackets of said tobacco rod are provided with an additional common, outer wrapping produced of cigarette paper or tobacco sheet.

9. The segmented filter cigarette as set forth in claim 1, wherein said filter comprises a coaxial filter consisting of a filter core, a third wrapping for said filter core, a filter jacket and a fourth wrapping for said filter jacket, said filter core and said filter jacket being structured of filter materials.

10. The segmented filter cigarette as set forth in claim 9, wherein said filter core has a diameter of 2.5 to 6.50 mm.

11. The segmented filter cigarette according to claim 10, wherein said filter core has a diameter of 3.5 to 5.5 mm.

12. The segmented filter cigarette as set forth in claim 9, wherein said third wrapping of the filter core consists of paper or a sheet, and has a low permeability to air.

13. The segmented filter cigarette as set forth in claim 12, wherein said wrapping of the filter core consists of a sheet of cellulose acetate or polyolefines, and is impermeable to air.

14. The segmented filter cigarette as set forth in claim 9, wherein said filter has at least one further filter segment adjoining an end of the filter opposite from an end of the filter attached to the tobacco rod.

15. The segmented filter cigarette as set forth in claim 9, wherein one of said two coaxial filter elements has a higher filtering effectiveness relative to the other filter element.

16. The segmented filter cigarette according to claim 9, wherein said filter core and said filter jacket of said filter are structured of fibers or non-woven fabric.

17. The segmented filter cigarette as set forth in claim 1, wherein the resistance to draw of said jacket of said first-burning segment, relative to a tobacco rod length of 63 mm, is 20 to 40 mm WC, whilst the resistance to draw of said inner core of this segment, relative to a tobacco rod length of63 mm, is 300 to 600 mm.

18. The segmented filter cigarette as set forth in claim 17, wherein the resistance to draw of said jacket of said first-burning segment, relative to a tobacco rod length of 63 mm, is 25 to 35 WC, whilst the resistance to draw of said inner core of this segment, is relative to a tobacco rod length of 63 mm, is 450 to 550 mm WC.

19. The segmented filter cigarette as set forth in claim 1, wherein the resistance to draw of said jacket of said filter-end segment, relative to a tobacco rod length of 63 mm, is 100 to 300 mm WC, whilst the resistance to draw of said inner core of said segment, relative to a tobacco rod length of 63 mm, is 50 to 150 mm WC.

20. The segmented filter cigarette as set forth in claim 19, wherein said the resistance to draw of said jacket of said filter-end segment, relative to a tobacco rod length of 63 mm, is 125 to 175 WC, whilst the resistance to draw of said inner core of said segment, relative to a tobacco rod length of 63 mm, is 75 to 125 mm WC.

21. The segmented filter cigarette as set forth in claim 1, wherein the filtering effectiveness of said filter core is 10 to 60%, whilst the filtering effectiveness of said filter jacket is 70 to 100%, and said filter has a degree of ventilation from 0 to 80%.

22. The segmented filter cigarette as set forth in claim 21, wherein the filtering effectiveness of said filter core is 10 to 30%, whilst the filtering effectiveness of said filter jacket is 90 to 100%.

23. The segmented filter cigarette as set forth in claim 1, wherein resistances to draw of the filter elements are adjusted as a function of the filter ventilation used so that the ratio sf of the stream of smoke flowing into said jacket of the coaxial filter to the stream of smoke flowing into said filter core of the coaxial filter is substantially equal to the ratio s2 of the amount of smoke flowing out of said jacket of the second segment to the amount of smoke flowing out of the inner core of the second segment, in each case after said first-burning tobacco rod segment has been smoked.

24. A segmented filter cigarette according to claim 1, wherein said first wrapping for said inner core has a low permeability to air.

25. The segmented filter cigarette as set forth in claim 1, wherein said first burning segment has a length corresponding to 0.1 to 0.8 the overall length of said tobacco rod.

26. The segmented filter cigarette according to claim 25, wherein said first burning segment has a length corresponding to 0.3 to 0.4 times the overall length of said tobacco rod.

27. A segmented filter cigarette comprising a) a tobacco rod including at least two segments of differing tobacco fillings, said segments including a first-burning segment and a filter-end segment, b) an outer wrapping around said tobacco rod, and c) a filter attached to one end of said tobacco rod in which d) said at lest two segments of said tobacco rod have a coaxial structure, each comprising d1) an inner core of tobacco material, d2) a first wrapping for said inner core, d3) a jacket of a tobacco material, and d4) a second wrapping highly permeable to air for said jacket;

e) the tobaccos of said inner cores of said segments have the same or a very similar condensate potential;

f) the tobaccos of said jackets of said segments have the same or a very similar condensate potential which differs from the condensate potential of said inner cores;

said inner cores and said jackets of said segments each having a resistance to draw, the resistance to draw for the inner core and the resistance to draw for the jacket of each segment being different such that, upon smoking of said cigarette:

g1) smoke is drawn substantially from the region having a high condensate potential of first-burning segment during smoking of the segmented filter cigarette, and g2) smoke is drawn substantially from the region of said segment having the lower condensate potential during smoking of the filter-end segment, wherein the ratio q1 of the resistance to draw of said jacket of the first-burning segment to the resistance to draw of said inner core of said first-burning segment is greater than the ratio q2 of the resistance to draw of said jacket of said filter-end segment to the resistance to draw of the inner core of said filter-end segment, and the condensate potential of the tobacco of said inner cores is high.

28. The segmented filter cigarette as set forth in claim 27, wherein the resistance to draw of said jacket of said filter-end segment, relative to a tobacco rod length of 63 mm, is 100 to 300 mm WC, whilst the resistance to draw of said inner core of said segment, relative to a tobacco rod length of63 mm, is 50 to 150 mm WC.

29. The segmented filter cigarette as set forth in claim 28, wherein the resistance to draw of said jacket of said filter-end segment, relative to a tobacco rod length of 63 mm, is 125 to 175 mm WC, whilst the resistance to draw of said inner core of said segment, relative to a tobacco rod length of 63 mm, is 70 to 80 mm WC.

30. The segmented filter cigarette as set forth in claim 27, wherein the resistance to draw of said jacket of said filter-end segment, relative to a tobacco rod length of 63 mm, is 25 to 100 mm WC, whilst the resistance to draw of said inner core of said segment relative to a tobacco rod length of 63 mm, is 125 to 300 mm WC.

31. The segmented filter cigarette as set forth in claim 30, wherein the resistance to draw of said jacket of said filter-end segment, relative to a tobacco rod length of 63 mm, is 25 to 40 mm WC, whilst the resistance to draw of said inner core of said segment, relative to a tobacco rod length of 63 mm, is 140 to 160 mm WC.

32. The segmented filter cigarette as set forth in claim 27, wherein the filtering effectiveness of said filter core is 70 to 100%, whilst the filtering effectiveness of said filter jacket is 10 to 60%, and said filter has a degree of ventilation from 0 to 80%.

33. The segmented filter cigarette as set forth in claim 32, wherein the filtering effectiveness of said filter core is 90 to 100%, whilst the filtering effectiveness of said filter jacket is 10 to 30%.

34. The segmented filter cigarette as set forth in claim 27, wherein said tobacco rod has an overall length of 40 to 100 mm.

35. The segmented filter cigarette according to claim 34, wherein the overall length of said tobacco rod is 45 to 70 mm.

36. The segmented filter cigarette as set forth in claim 27, wherein said inner cores have a diameter of 3 to 10 mm.

37. The segmented filter cigarette according to claim 36, wherein said inner cores have a diameter of 3 to 10 mm.

38. The segmented filter cigarette as set forth in claim 27, wherein said inner cores and/or said jackets of said tobacco rod are provided with an additional common, outer wrapping produced of cigarette paper or tobacco sheet.

39. The segmented filter cigarette as set forth in claim 27, wherein said filter comprises a coaxial filter consisting of a filter core, a third wrapping for said filter core, a filter jacket and a fourth wrapping for said filter jacket, said filter core and said filter jacket being structured of filter materials.

40. The segmented filter cigarette as set forth in claim 39, wherein said filter core has a diameter of 2.5 to 6.50 mm.

41. The segmented filter cigarette according to claim 40, wherein said filter core has a diameter of 3.5 to 5.5 mm.

42. The segmented filter cigarette as set forth in claim 39, wherein said third wrapping of the filter core consists of paper or a sheet, and has a low permeability to air.

43. The segmented filter cigarette as set forth in claim 42, wherein said wrapping of the filter core consists of a sheet of cellulose acetate or polyolefines, and is impermeable to air.

44. The segmented filter cigarette as set forth in claim 39, wherein said filter has at least one further filter segment adjoining an end of the filter opposite from an end of the filter attached to the tobacco rod.

45. The segmented filter cigarette as set forth in claim 39, wherein one of said two coaxial filter elements has a higher filtering effectiveness relative to the other filter element.

46. The segmented filter cigarette according to claim 39, wherein said filter core and said filter jacket of said filter are structured of fibers or non-woven fabric.

47. A segmented filter cigarette according to claim 27, wherein said first wrapping for said inner core has a low permeability to air.

* * * * *